United States Patent [19]

Bledsoe

[11] 3,988,806

[45] Nov. 2, 1976

[54] APPARATUS FOR CLEANING SEED COTTON

[76] Inventor: Woodrow W. Bledsoe, 2775 Dalewood, Memphis, Tenn. 38127

[22] Filed: June 30, 1975

[21] Appl. No.: 592,068

[52] U.S. Cl. ..... 19/203

[51] Int. Cl.[2] ..... D01G 1/00

[58] Field of Search ..... 19/200, 202, 203, 204, 19/205; 209/133, 135, 138, 139; 56/13.3, 12.8, 16.5, 16.6, 30

[56] References Cited

UNITED STATES PATENTS

| | | | |
|---|---|---|---|
| 1,941,124 | 12/1933 | Ziegler | 56/13.3 X |
| 3,172,165 | 3/1965 | Helm | 19/205 X |
| 3,769,660 | 11/1973 | Schuette, Jr. | 19/202 |

FOREIGN PATENTS OR APPLICATIONS

| | | | |
|---|---|---|---|
| 320,567 | 7/1972 | U.S.S.R. | 19/202 |

*Primary Examiner*—Dorsey Newton
*Attorney, Agent, or Firm*—John R. Walker, III

[57] ABSTRACT

An apparatus for removing trash from seed cotton. The comingled seed cotton/trash are conveyed by air velocity into the housing of the apparatus wherein they are made to follow the outer curve of the top panel until arrested by a spiked rotating beater cylinder having a first grid section disposed thereabout for expelling the rushing air and the entrained minute pieces of trash. As the beater directs the remaining portion of cotton/trash toward a rotating primary saw drum, the larger pieces of trash gravitate into a bypass hopper from which certain structure reclaims the seed cotton which may be comingled therewith. The reclaimed seed cotton is redirected onto the primary saw drum which also engages and holds the seed cotton being thrown thereon by the beater cylinder. A portion of the seed cotton impaled upon the primary saw drum has considerable intermediate size pieces of trash comingled therewith. These pieces of trash are caused to engage sequentially a plurality of stripper grid bars as the primary saw drum rotates. This engagement is effective to strip or separate the intermediate size pieces of trash from the seed cotton. However, residual trash particles too small to be removed by the stripper grid bars pass on to the air washing structure where they are exposed to a high velocity blast of air whereby the seed cotton is air washed. This air blast picks up the residual trash and entrains it with the main air stream which introduces the comingled seed cotton/trash into the apparatus, i.e., ultimately being expelled through the first grid section. The clean seed cotton is doffed from the primary saw drum and is caused to pass on to certain structure for further processing, e.g., a cotton gin which removes the seeds from the seed cotton.

13 Claims, 5 Drawing Figures

FIG. 3
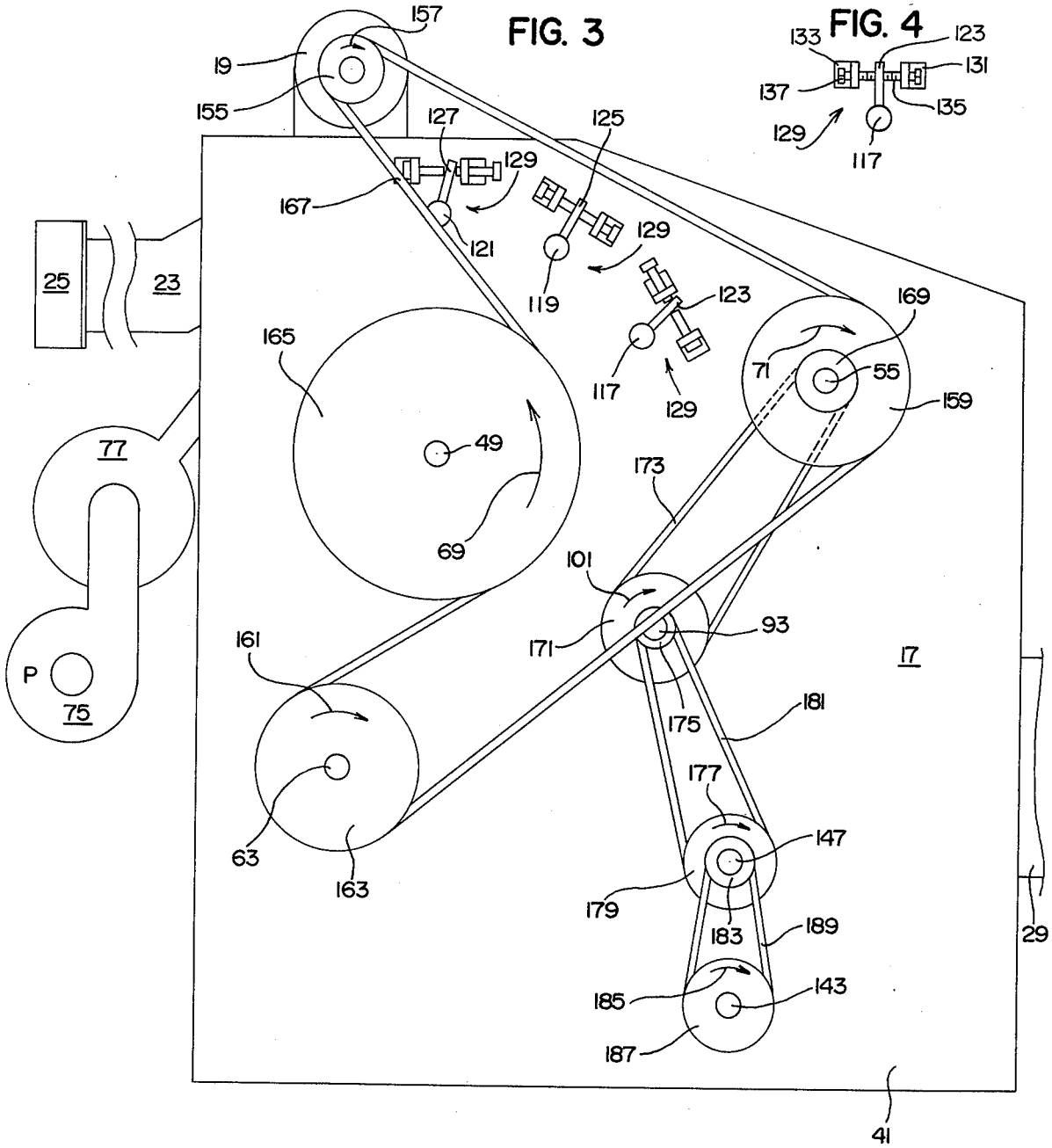
FIG. 4
FIG. 5
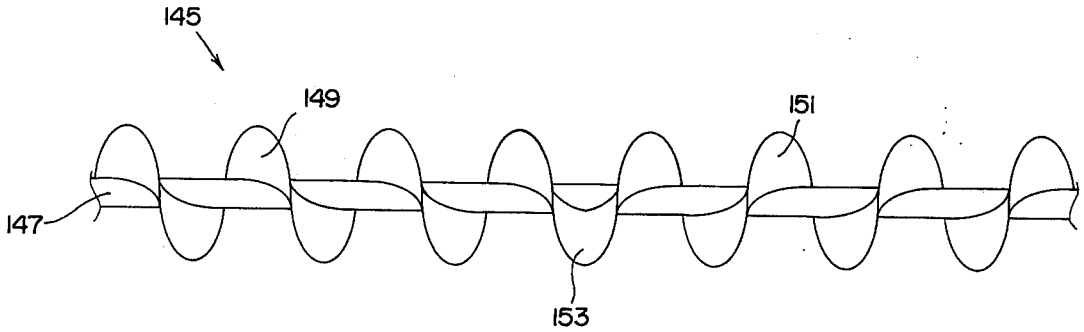

APPARATUS FOR CLEANING SEED COTTON

BACKGROUND OF THE INVENTION

1. Field of the Invention

This invention relaates to the field of devices for cleaning seed cotton and is particularly directed toward cotton cleaning apparatus which uses pneumatic conveyor means for conveying the cotton through the apparatus.

2. Description of the Prior Art

Normally, the comingled seed cotton/trash are dropped into a cylinder and the rotating saw grabs the seed cotton while the trash is thrown off by centrifugal force.

Cotton cleaning devices of the same general type as herein disclosed are taught by the Day U.S. Pat. No. 2,948,022 and the Helm U.S. Pat. No. 3,172,165. However, neither of the above-mentioned patents suggest or disclose applicant's device.

SUMMARY OF THE INVENTION

The concept of the present invention is to provide apparatus for throughly cleaning seed cotton. The apparatus of the present invention may be of a permanent installation or portable. That is, the complete system can be factory assembled and shipped as a unit, or the complete unit can be mounted on wheels, a trailer or truck and be transported to the cotton field for total processing of the cotton in the field.

The seed cotton cleaner of the present invention will process all types of cotton and will more effectively remove trash than previously known cleaning apparatus. In other words, the apparatus of the present invention will more effectively remove trash than even the well known concept of arranging two or three prior cleaning machines in sequential combination.

The comingled seed cotton/trash are conveyed by air velocity into the housing of the apparatus wherein they are made to follow the outer curve of the top panel until arrested by a spiked rotating beater cylinder having a first grid section disposed thereabout for expelling the rushing air and the entrained minute pieces of trash. As the beater directs the remaining portion of cotton/trash toward a rotating primary saw drum, the larger pieces of trash gravitate into a bypass hopper from which certain structure reclaims the seed cotton which may be comingled therewith. The reclaimed seed cotton is redirected onto the primary saw drum which also engages and holds the seed cotton being thrown thereon by the beater cylinder. A portion of the seed cotton impaled upon the primary saw drum has considerable intermediate size pieces of trash comingled therewith. These pieces of trash are caused to engage sequentially a plurality of stripper grid bars as the primary saw drum rotates. This engagement is effective to strip or separate the intermediate size pieces of trash from the seed cotton. However, residual trash particles too small to be removed by the stripper grid bars pass on to air washing structure where they are exposed to a high velocity blast of air whereby the seed cotton is air washed. The air blast picks up the residual trash and entrains it with the main air stream which introduces the comingled seed cotton/trash into the apparatus, i.e., ultimately being expelled through the first grid section. The clean seed cotton is doffed from the primary saw drum and is caused to pass on to certain structure for further processing, e.g., a cotton gin which removes the seeds from the seed cotton.

One of the problems of prior cleaning machines is that much of the trash returns to the cotton on the drum, i.e., by the circulating air created by the revolving saw drum. One object of the present invention is to overcome the problem of coadunation of the trash with the seed cotton that is held on the revolving saw drum.

Another important feature of the present invention is the fall out area or bypass means provided for removing large particles of trash. In other words, the fall out area or bypass means is void of air velocity and particles too large to pass through the first grid section will drop to the reclaimer saw, since most foreign material will not be engaged by the saw teeth of the primary saw drum. Thus, large stems, hulls, bolls and other foreign matter will pass to the reclaimer saw along with a very small amount of cotton which is entangled or comingled with the foreign material. The reclaimer saw teeth will engage the fibers of this cotton and pull it loose from the foreign material or trash which drops over the lip of the second grid section to a screw conveyor below. The seed cotton engaged by the reclaimer saw teeth passes over the second grid section where smaller trash may be loosened or separated and drop out through the second grid section. The teeth of the primary saw drum remove the cotton fibers from the teeth of the reclaimer cylinder because of the proximity thereof and also since the rim speed of the primary saw drum is much greater than the rim speed of the reclaimer saw.

Another important feature of the present invention is the means for adjusting the cleaning effectiveness of the primary saw drum. Typical cotton cleaners simply bolt or fixedly attach the grid bars at predetermined positions with respect to the rotating primary saw drum. The apparatus of the present invention includes control levers attached to one of the ends of the respective stripper grid bars and since the grid bars are oblong in cross section moving the levers effectively rocks the respective stripper grid bar or varies the distance between the surface of the rotating saw drum and the respective stripper grid bars. In other words, a preferred arrangement would have the leading edge of the first stripper grid bar adjusted a greater distance from the surface of the primary saw drum so as to remove the larger pieces of trash. The leading edge of the second stripper grid bar would be set closer to the surface of the rotating primary saw drum and the leading edge of the third stripper grid would be even closer. In this way, it is possible to progressively clean the trash from the cotton in stages without damage to the cotton and yet achieve maximum grid cleaning by the third stripper grid bar.

Another important feature of the present invention is the introduction of the means for air washing the seed cotton which includes the principle of cleaning leaf and fine trash from the seed cotton after the larger foreign material has been removed in the preceding cleaning processes. In other words, by forcing air through nozzles at a high velocity onto the saw drum, counter to the direction of the moving cotton, considerable force is exerted on the cotton fibers and the leaf and fine trash is separated from the cotton fibers. The trash that is removed here is conveyed by air to the first grid section where it is expelled through the exhaust duct.

It will be appreciated by those skilled in the art that the present invention encompasses numerous cleaning steps and each one assists and compliments the other.

The several cleaning steps are: (1) the beater spike cylinder, (2) the first grid section disposed about the beater spike cylinder, (3) the bypass means or reclaimer saw area including the second grid section, (4) the centrifugal action of the rotating primary saw drum, (5) the first stripper grid bar, (6) the second stripper grid bar, (7) the third stripper grid bar, (8) the main air stream which prevents coadunation of the trash with the seed cotton that is held on the primary saw drum, and (9) the means for air washing the minute particles of trash from the seed cotton and introducing these particles into the main air stream.

Prior cotton cleaning apparatus usually required that the comingled seed cotton and trash be first processed through a separator which removed the more bulky pieces of trash. The apparatus of the present invention includes structure for effectively separating the more bulky or larger pieces of trash, i.e., the spike beater cylinder alluded to above. Therefore, the present invention eliminates the necessity of first removing the more bulky pieces of trash. In other words, the apparatus of the present invention is intended to normally receive the comingled seed cotton and trash direct from the cotton picker, i.e., either at the cotton field or at a centrally located permanent installation. However, it should be pointed out that under certain conditions it may be desirable to first pass the comingled seed cotton and trash through a cotton drier, i.e., in the event the moisture content is higher than optimum conditions commensurate with the cleaning process.

DESCRIPTION OF THE DRAWINGS

FIG. 3 is a view similar to FIG. 1 with the view being taken prior to the side panel being removed and shows the preferred arrangement of certain drive structure.

FIG. 4 is an enlarged view of one of the stripper grid bar levers and showing adjustment means for immobilizing the lever selectively in any one of infinite positions.

FIG. 5 is a frontal view of the screw conveyor structure of the present invention.

DESCRIPTION OF THE PREFERRED EMBODIMENT

Figure 1:
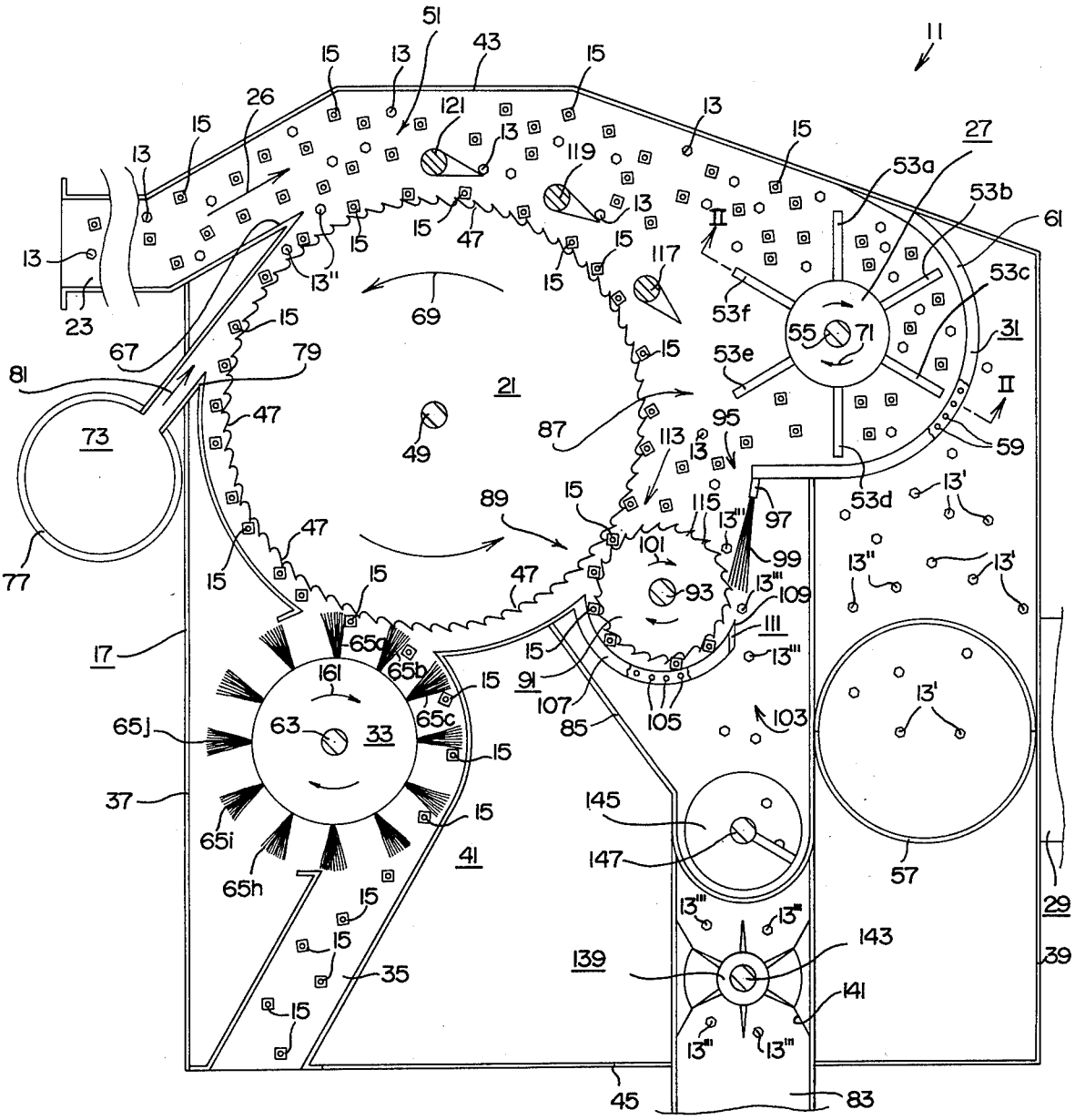
FIG. 1 is a sectional view of the seed cotton cleaning apparatus of the present invention with the view being taken as on a vertical plane so as to effectively remove one side panel thereof.

The apparatus 11 of the present invention is intended for segregating trash, generally character referenced by the numeral 13, from seed cotton, character referenced by the numeral 15. The apparatus 11 includes frame-like housing means, as at 17, a prime mover 19 for rotatably driving certain structure of the apparatus 11, i.e., the apparatus being driven by the prime mover 19 will be fully disclosed as the specification proceeds. Also included is a primary saw drum 21 for engaging and holding the seed cotton 15. The saw drum 21 is journaled to the housing means 17 and is operably coupled to the prime mover 19, in a manner to be fully disclosed, for rotation in a predetermined direction about a horizontal axis. Also included is an entry duct 23 disposed adjacent the primary saw drum 21 for admitting the comingled seed cotton 15 and trash 13 into the housing means 17. Pneumatic conveyor means, as at 25, is provided for moving the comingled seed cotton 15 and trash 13 in the direction of an arrow 26 into the entry duct means 23. The apparatus 11 also includes beater means, as at 27, for arresting and agitating the comingled seed cotton 15 and trash 13 and for directing at least a portion thereof toward the primary saw drum 21 in a manner which will be more apparent as the specification proceeds. The beater means 27 is journaled to the housing means 17 and is operably coupled to the prime mover 19 for rotation in a predetermined direction about a horizontal axis. A first outlet duct, as at 29, is included and leads outwardly from the housing means 17, i.e., being suitably disposed downstream of the beater means 27 for discharging from the housing means 17 the rushing air being moved by the pneumatic conveyor means 25 and for discharging at least a first portion of the segregated trash which may hereinafter be more specifically character referenced by the numeral 13'. Disposed adjacent the beater means 27 is a first grid section, as at 31, for removing the first portion of trash 13' from the seed cotton 15 as the rushing air passes outwardly therethrough. Suitable doffing means, as at 33, are provided for removing the clean seed cotton 15 from the primary saw drum 21. Leading outwardly from the housing means 17 is a seed cotton discharge duct, as at 35, for receiving the clean seed cotton 15 from the doffing means 33 and for preferably directing the seed cotton 15 to further processing apparatus, e.g., a cotton gin which removes the seeds from the seed cotton.

The frame-like housing means 17 includes a front panel member 37; a rear panel member 39; a pair of side panel members 41 joining the front and rear panels 37, 39 one to the other; a top panel member 43 suitably attached to the panels 37, 39, 41; and a bottom panel member 45 also suitably attached to the panels 37, 39, 41. Thus, the interior of the housing means is sealably enclosed from without. It should be understood that the top panel member 43 may include a plurality of angularly displaced surfaces as shown in FIG. 1 or it may be arcuate shaped if desirable, for reasons which will be more apparent as the specification proceeds.

The primary saw drum 21 preferably is in the shape of an elongated cylinder and includes a plurality of saw teeth, as at 47, projecting outwardly from the surface thereof. The drum 21 extends between the side panel members 41 and is journaled thereto by a shaft 49. From FIG. 1 of the drawings it may be seen that a space, as at 51, exists between the top panel member 43 and the outer periphery of the drum 21. It will be appreciated by those skilled in the art that the space 51 is utilized in a manner to be fully disclosed in conjunction with certain structure so as to establish an important feature of the present invention.

The entry duct means 23 extends between the side panel members 41 so that the comingled seed cotton and trash 13 are delivered into the housing 17 in a rather wide pattern, i.e., substantially extending between the side panel members 41. The pneumatic conveyor means 25 forms no part of the present invention and is simply diagrammatically depicted in FIG. 3 of the drawings. In this regard, it should be understood that the pneumatic conveyor means 25 may be disposed upstream of the entry duct means 23 as shown, or it may be disposed downstream of the first outlet duct 29 in any suitable manner according to the latest state of the art.

Figure 2:
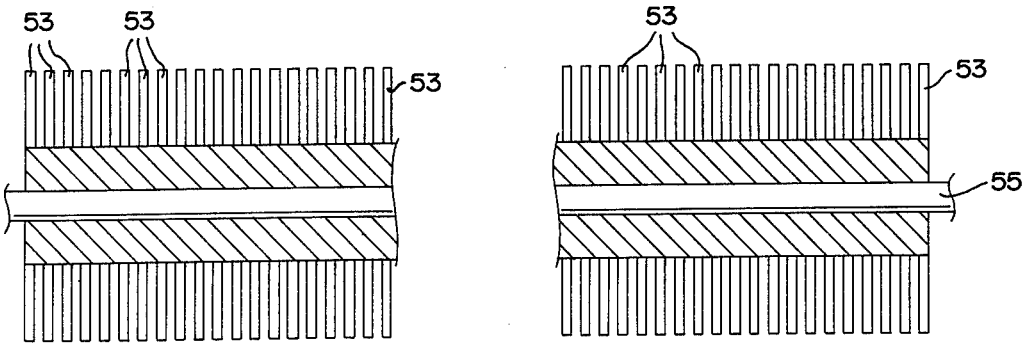
FIG. 2 is a sectional view taken as on the line II—II of FIG. 1 showing the spike beater cylinder of the present invention.

From FIGS. 1 and 2 of the drawings it may be seen that the beater means 27 includes a spiked cylinder which extends between the side panel member 41. In other words, the beater means 27 includes a plurality of spaced apart spikes 53 which are preferably arranged in a plurality of rows, as at 53*a*, 53*b*, 53*c*, etc. The beater means 27 also includes a shaft 55 which is journaled to the side panel members 41, the rows 53*a*, 53*b*, 53*c*, etc., extend parallel with the shaft 55.

The first outlet duct means 29 includes an upwardly directed trough-like member 57 which initially receives the trash 13′ from the first grid section 31. The trough-like member 57 leads outwardly from the housing 17 to suitable enclosed duct structure which carries the trash 13′ to a suitable discharge point, not shown.

The first grid section 31 includes a plurality of parallel spaced apart rod members 59 which extend between the side panel members 41. More specifically, a pair of arcuate spaced apart support members 61, only one of which is shown, have the remote ends of the rod members 59 fixedly attached thereto in any well known manner as by welding or the like. FIG. 1 shows a mid-portion of the support member 61 broken away to reveal the rod members 59.

The doffing means 33 preferably is cylindrical in shape and extends between the side panel members 41 having a rotatable shaft 63 journaled to the side panel members 41. The doffing means 33 preferably includes a plurality of bristles 65 arranged in spaced apart rows extending parallel with the shaft 63, as at 65*a*, 65*b*, 65*c*, etc., and which remove the clean seed cotton 15 from the drum 21 in a manner which will be more apparent as the specification proceeds.

The seed cotton discharge duct 35 extends between the side panel members 41 so that minimum resistance is offered the clean seed cotton 15 being received therein from the doffing means 33.

From FIG. 1 of the drawings it may be seen that the apparatus 11 includes deflector means, as at 67, which is interposed between the entry duct 23 and the primary saw drum 21 for deflecting the comingled cotton 15 and trash 13 entering through the entry duct means 21 to be caused to move along a prescribed path, i.e., through the space 51. In other words, the deflector means 67 is effective to cause the prescribed path of the commingled cotton 15 and trash 13 to be adjacent the top panel member 43 and at a spaced distance above the primary saw drum 21 thus precluding coadunation of the comingled cotton 15 and trash 13 with the clean seed cotton 15 that is held on the primary saw drum 21. Prior cleaning devices usually permitted all of the incoming cotton and trash to travel in a straight path causing all of the cotton and trash to be thrown against the teeth of the drum. The beater means 27 of the present invention receives all of the seed cotton and trash and a portion of the trash 13′ is immediately separated from the seed cotton 15 with a discriminating portion of the trash 13 being directed onto the teeth 47 of the drum 21, in a manner to be more fully disclosed. However, it should be pointed out that the drum 21 rotates in the direction of an arrow 69 and the beater means 27 rotates in the direction of an arrow 71.

The apparatus 11 also includes means, as at 73, for air washing minute particles of trash 13″ from the seed cotton 15 with the removed minute particles 13″ being directed toward the first grid section 31 for ultimate discharge through the first outlet duct means 29. More specifically, the means 73 includes a source of air pressure, e.g., a blower 75, manifold means, as at 77, communicated with the blower 75, and nozzle means 79 communicated with the manifold means 77. From FIG. 1 of the drawings it may be seen that the nozzle means 79 is arranged to direct the air emanating therefrom against the surface of the primary saw drum 21 whereby the seed cotton 15 being held thereon is air washed. Also, the flow of air from the nozzle means 79 is directed to flow in a direction, i.e., in the direction of an arrow 81, which is opposite from the direction of travel of the surface of the primary saw drum, i.e., the direction of the arrow 81 is opposite to the direction of the arrow 69. However, the direction of the arrow 81 is substantially the same as the direction of the main air stream shown by the arrow 26.

The apparatus 11 also includes second outlet duct means, as at 83, which leads outwardly from the housing means 17 for discharging a second portion of the segregated trash which may hereinafter be more specifically character referenced by the numeral 13‴. Also included is by-pass means, as at 85, for initially receiving from the beater means 27 the second portion of the segregated trash 13‴ which may also unintentionally contain or include a certain amount of recoverable seed cotton 15, i.e., a very small amount of cotton which is entangled with the foreign material. From FIG. 1 of the drawings it may clearly be seen that the by-pass means 85 is communicated with the second outlet duct means 83. Additionally, the beater means 27 is disposed a predetermined spaced apart distance from the primary saw drum 21 with the generatrices thereof jointly defining at least in part an elongated gap, as at 87, i.e., the elongated gap 87 extending between the side panel members 41. The by-pass means 85 is disposed subjacent to and communicated with the elongated gap 87 whereby the second portion of trash 13‴ that enters into the second outlet duct means 83 gravitates downwardly passing first through the elongated gap 87, thence through the by-pass means 85, and ultimately being discharged through the second outlet duct means 83.

The apparatus 11 includes reclaimer means, as at 89, disposed within the by-pass means 85 for reclaiming the recoverable seed cotton 15 from the trash 13‴ which entered the by-pass means 85. The reclaimer means 89 includes a secondary saw drum 91 disposed subjacent the gap 87 for engaging and holding the reclaimed seed cotton 15. The secondary saw drum 91 includes a rotatable shaft 93 which is journaled to the side panel members 41 and is operably coupled to the prime mover 19 for rotation in a predetermined direction about a horizontal axis. It should be understood that the secondary saw drum has a cylindrical shape somewhat like the primary saw drum 21 and extends between the side panel members 41 in like manner. Also include is elongated brush means 95 fixedly attached to the housing means 17, or more specifically, to the support members 61, for urging the trash 13‴ gravitating downwardly from the gap 87 firmly against the secondary saw drum 91. The brush means 95 includes an elongated bar 97 which extends between the support members 61 and a plurality of flexible bristles 99 for enabling the trash 13‴ to yieldably flex the bristles 99 as the trash 13‴ passes between the secondary saw drum 91 and the brush means 95, i.e., the bristles 99 being arranged in one continuous row which extends substantially between the side panel members 41. It should be mentioned that the secondary saw drum 91 is caused to rotate in the direction of an arrow 101 in a manner to be fully disclosed.

The apparatus 11 also includes second grid section means 103 disposed adjacent the secondary saw drum 91 for separating the reclaimed seed cotton 15 from the trash 13''' which entered the by-pass means 85. It should be understood that the second grid section 103 is similar in construction to the previously described first grid section 31, i.e., a plurality of spaced apart rod members 105 are supported adjacent the periphery of the secondary saw drum 91 by a pair of arcuate shaped support members 107, only one support member 107 being shown. The second grid section 103 includes a lip portion, as at 109, disposed adjacent the leading edge thereof, i.e., the lip portion 109 preferably being a part of an elongated flat bar 111 which extends between the support members 107, for engaging and ejecting the largest pieces of trash 13''' as the secondary saw drum 91 rotates.

The apparatus 11 also includes means, as at 113, for transferring the recovered seed cotton 15 from the secondary saw drum 91 to the primary saw drum 21. More specifically, the means 113 includes positioning the respective primary and secondary saw drums 21, 91 in close proximity one with the other and causing the primary and secondary saw drums 21, 91 to be rotated in opposite directions, i.e., as clearly indicated by the respective arrows 69, 101. Additionally, the surface velocity of the primary saw drum 21 exceeds the surface velocity of the secondary saw drum 91 by establishing optimum speeds for the shafts 49, 93 in a manner to be fully disclosed later in the specification. It should be mentioned that the secondary saw drum 91 includes numerous saw teeth 115 which are somewhat similar to the above-described saw teeth 47 for the primary saw drum 21. Accordingly, the respective teeth 47, 115 of the primary and secondary saw drums 21, 91 are directed toward their respective direction of travel as they are rotatably driven which causes the teeth 47 to strip the seed cotton 15 from the teeth 115.

The apparatus 11 also includes a plurality of elongated horizontally disposed stripper grid bars 117, 119, and 212 for sequentially engaging the comingled seed cotton 15 and trash 13 being held by the primary saw drum 21 and for pulling particles of trash 13 free from the seed cotton 15 as the primary saw drum 21 rotates. The remote ends of each of the stripper grid bars 117, 119, and 121 are rotatably attached to the side panel members 43. From FIG. 1 of the drawings it may clearly be seen that each of the stripper grid bars 117, 119, 121 are oblong in cross-section and are disposed adjacent the periphery of the primary saw drum 21. From FIGS. 3 and 4 of the drawings it may clearly be seen that a plurality of levers 123, 125, 127 are fixedly attached respectively to the stripper grid bars 117, 119, 121 for selectively rocking the stripper grid bars 117, 119, 121 about their rotating axes to infinite positions. Further, each of the stripper grid bars 117, 119, 121 incorporates adjustment means, as at 129, for immobilizing the respective levers 123, 125, 127 selectively in any one of the infinite positions thereof.

More specifically, in referring to FIG. 4 of the drawings it may be seen that adjustment means 129 includes a pair of confrontingly arranged bracket members 131, 133 which straddle each lever 123. Additionally, a pair of adjustment bolt members 135, 137 are threadedly received in suitable apertures provided in the respective bracket members 13, 133 for immobilizing the levers 123 selectively in any one of the infinite positions thereof.

The apparatus 11 preferably includes seal means, as at 139, for discharging the trash 13''' which entered the by-pass means 85. The second outlet duct means 83 is provided with a downwardly directed mouthlike opening, as at 141, leading outwardly from the housing 17. From FIG. 1 of the drawings it may clearly be seen that the seal means 139 is disposed within the mouthlike opening 141. Further, the seal means 139 includes a rotatable shaft 143 which is journaled to the side panel members 41 and is operably coupled to the prime mover 19 for rotation about a horizontal axis whereby the trash 13''' may be discharged from the by-pass means 84 while a substantially static air pressure is maintained therein. It should be mentioned that revolving seal means of the same general type as herein described are shown in the previously mentioned U.S. Pat. No. 3,172,165. Therefore, the above brief description of seal means 139 will suffice for present purposes, reference should be made to U.S. Pat. No. 3,172,165 for a more detailed description of the character and structure of the seal means 139.

The apparatus 11 also includes screw conveyor means 145 disposed within the by-pass means 85 as clearly shown in FIG. 1 of the drawings. The screw conveyor means 145 is disposed subjacent the secondary saw drum 91 for receiving and laterally moving the trash 13''' which entered the by-pass means 85, i.e., the trash 13''' is free to gravitate into the screw conveyor means 145 from the second grid section 103. The screw conveyor means 145 includes a rotatable shaft 147 which is journaled to the side panel members 41 and is operably coupled to the prime mover 19 for rotation in a predetermined direction about a horizontal axis. From FIG. 5 of the drawing it may be seen that the screw conveyor means 145 includes a left hand screw pitch member, as at 149, and a right hand screw pitch member, as at 151. The left and right hand members 149, 151 converge inwardly at central discharge vane 153. Therefore, rotation of the screw conveyor means 145 in a predetermined direction causes the trash 13''' to move inwardly from either end thereof toward the central discharge vane 153. Accordingly, the width of the seal means 139 need not extend the full distance between the side panel members 41 since all of the trash 13''' passing therethrough is received from the central discharge vane 153, i.e., being congregated substantially midway between the side panel members 41.

Particular attention is now directed toward FIG. 3 of the drawings in which it may be seen that the prime mover 19 includes pulley structure 155 which is rotatably driven in the direction of an arrow 157. Additionally, the shaft 55 for the beater means 27 is rotatably driven in the direction of the arrow 71 by pulley structure as at 159. Additionally, the shaft 63 for the doffing means 33 is rotatably driven in the direction of an arrow 161 by pulley structure, as at 163. Further, the shaft 49 is rotatably driven in the direction of the arrow 69 by pulley structure, as at 165. Endless belt structure, as at 167, frictionally engages the several pulley devices, 115, 159, 163 and 165 as clearly shown.

Further reference is made to FIG. 3, wherein it may be seen that the shaft 55 rotatably drives pulley structure, as at 169, also in the direction of the arrow 71. Additionally, the shaft 93 is rotatably driven in the direction of the arrow 101 by pulley structure, as at 171. Endless belt structure, as at 173, frictionally engages the pulley devices 169, 171. Pulley structure, as at 175, is rotatably driven by the shaft 93. The shaft 147 is rotatably driven in the direction of an arrow 177 by pulley structure, as at 179. Endless belt structure, as at 181, frictionally engages the pulley devices 175, 179. The shaft 147 rotatably drives pulley structure, as at 183, in the direction of the arrow 177. The shaft 143 is rotatably driven in the direction of an arrow 185 by pulley structure, as at 187. Endless belt structure, as at 189, frictionally engages the pulley devices 183, 187 as clearly shown.

Although the invention has been described and illustrated with respect to a preferred embodiment thereof, it is to be understood that it is not to be so limited since changes and modifications may be made therein which are within the full intended scope of the invention.

I claim:

1. Apparatus for segregating trash from seed cotton, said apparatus comprising framelike housing means, a prime mover for rotatably driving certain structure of said apparatus, a primary saw drum for engaging and holding the seed cotton, said primary saw drum being journaled to said housing means and being operably coupled to said prime mover for rotaton in a predetermined direction about a horizontal axis, entry duct means disposed adjacent said primary saw drum for admitting the comingled seed cotton/trash into said housing means, pneumatic conveyor means for moving the comingled seed cotton/trash into said entry duct means, beater means for arresting and agitating the comingled seed cotton/trash and for directing at least a portion thereof toward said primary saw drum, said beater means being journaled to said housing means and being operable coupled to said prime mover for rotation in a predetermined direction about a horizontal axis, first outlet duct means leading outwardly from said housing means and being disposed downstream of said beater means for discharging from said housing means the rushing air being moved by said pneumatic conveyor means and at least a first portion of the segregated trash, first grid section means disposed adjacent said beater means for separating said first portion of the trash from the seed cotton as the rushing air passes outwardly therethrough, doffing means for removing the clean seed cotton from said primary saw drum, and seed cotton discharge duct means leading outwardly from said housing means for receiving the clean seed cotton from said doffing means and for directing the seed cotton to certain further processing apparatus.

2. The apparatus as set forth in claim 1 in which is included deflector means interposed between said entry duct means and said primary saw drum for deflecting the comingled cotton/trash entering through said entry duct means to be caused to move along a prescribed path, said housing means having a substantially horizontally disposed top panel member, said deflector means being effective to cause the prescribed path of the comingled cotton/trash to be adjacent said top panel member and at a spaced distance above said primary saw drum thus precluding coadunation of the comingled cotton/trash with the substantially clean seed cotton being held by said primary saw drum.

3. The apparatus as set forth in claim 1 in which is included means for air washing minute particles of trash from the seed cotton with the removed minute particles of trash being directed toward said first grid section means for ultimate discharge through said first outlet duct means.

4. The apparatus as set forth in claim 3 in which said means for air washing minute particles of trash from the seed cotton includes a source of air pressure, manifold means communicated with source of air pressure, and nozzle means communicated with said manifold means; said nozzle means being arranged to direct the air emanating therefrom against the surface of said primary saw drum whereby the seed cotton being held thereon is air washed, the flow of air from said nozzle means being directed to flow in a direction which is opposite from the direction of travel of the surface of said primary saw drum.

5. The apparatus as set forth in claim 1 in which is included second outlet duct means leading outwardly from said housing means for discharging a second portion of the segregated trash, and by-pass means communicated with said second outlet duct means for initially receiving from said beater means the second portion of the segregated trash which may also unintentionally contain a certain amount of recoverable seed cotton, said beater means being disposed a predetermined spaced apart distance from said primary saw drum with the generatrices thereof jointly defining at least in part an elongated gap, said by-pass means being disposed subjacent to and communicated with said elongated gap whereby the second portion of trash that enters into said second outlet duct means gravitates downwardly passing first through said elongated gap thence through said by-pass means for ultimate discharge through said second outlet duct means.

6. The apparatus as set forth in claim 5 in which is included reclaimer means disposed within said by-pass means for reclaiming the recoverable seed cotton from the trash which entered said by-pass means, said reclaimer means includes a secondary saw drum disposed subjacent said elongated gap for engaging and holding the reclaimed seed cotton, said secondary saw drum being journaled to said housing means and being operably coupled to said prime mover for rotation in a predetermined direction about a horizontal axis, and brush means fixedly attached to said housing means for urging the trash gravitating downwardly from said elongated gap firmly against said secondary saw drum, said brush means having flexible bristles for enabling the trash to yieldably flex said bristles as the trash passes between said secondary saw drum and said brush means.

7. The apparatus as set forth in claim 6 in which is included second grid section means disposed adjacent said secondary saw drum for separating the reclaimed seed cotton from the trash which entered said by-pass means, said second section grid means including a lip portion disposed adjacent the leading edge thereof for engaging and ejecting the largest pieces of the trash as said secondary saw drum rotates.

8. The apparatus as set forth in claim 7 in which said primary and secondary saw drums are positioned in close proximity one with the other for allowing the recovered seed cotton to pass from said secondary saw drum to said primary saw drum.

9. The apparatus as set forth in claim 8 in which said primary and secondary saw drums are rotated in opposite directions with the surface velocity of said primary saw drum exceeding the surface velocity of said secondary saw drum and with the teeth of said primary and secondary saw drums being directed toward their respective direction of travel as they are rotatably driven for aiding the transfer of the recovered seed cotton from said secondary saw drum to said primary saw drum.

10. The apparatus as set forth in claims 1 in which is included a plurality of elongated horizontally disposed stripper grid bars for sequentially engaging the seed cotton/trash being held by said primary saw drum and for pulling particles of trash free from the seed cotton as said primary saw drum rotates, said stripper grid bars being rotatably attached to said housing means and disposed adjacent the periphery of said primary saw drum and respectively being oblong in cross-section, a plurality of levers fixedly attached respectively to said plurality of stripper grid bars for selectively rocking said bars about their rotating axes to infinite positions, and adjustment means for immobilizing said levers selectively in any one of the infinite positions thereof.

11. The apparatus as set forth in claim 7 in which is included seal means for discharging the trash which entered said by-pass means, said second outlet duct means being provided with a downwardly directed mouthlike opening; said seal means being disposed within said mouthlike opening, being journaled to said housing means, and being operably coupled to said prime mover for rotation about a horizontal axis whereby the trash may be discharged from said by-pass means while a substantially static air pressure is maintained therein.

12. The apparatus as set forth in claim 11 in which is included screw conveyor means disposed within said by-pass means and being subjacent said secondary saw drum for receiving and laterally moving the trash which entered said by-pass means, the trash being free to gravitate into said screw conveyor means from said second grid section means, said screw conveyor means being journaled to said housing means and being operably coupled to said prime mover for rotation in a predetermined direction about a horizontal axis.

13. Apparatus for removing trash from seed cotton, said apparatus comprising framelike housing means having a top panel member, a prime mover for rotatably driving certain structure of said apparatus, a primary saw drum for engaging and holding the seed cotton, said primary saw drum being journaled to said housing means and being operably coupled to said prime mover for rotation in a predetermined direction about a horizontal axis, entry duct means disposed adjacent said primary saw drum for admitting the comingled seed cotton/trash into said housing means, pneumatic conveyor means for moving the comingled seed cotton/trash into said entry duct means, beater means for arresting and agitating the comingled seed cotton/trans and for directing at least a portion thereof toward said primary saw drum, said beater means being journaled to said housing means and being operably coupled to said prime mover for rotation in a predetermined direction about a horizontal axis, said primary saw drum being disposed between said entry duct means and said beater means, deflector means interposed between said entry duct means and said primary saw drum for effectively deflecting the incoming comingled cotton/trash to be caused to move along a prescribed path in proximity to said top panel member and at a spaced distance from said primary saw drum, means for air washing minute particles of trash from the seed cotton including means for directing a continuous blast of air pressure against the surface of said primary saw drum, first outlet duct means leading outwardly from said housing means and being disposed downstream of said beater means for discharging from said housing means the rushing air being moved by said pneumatic conveyor means and at least a first portion of the segregated trash, first grid section means disposed adjacent said beater means for separating said first portion of the trash from the cotton as the air being moved by said penumatic conveyor means and said first portion of trash entrained therewith passes outwardly through said first grid means for ultimate discharge through said first outlet duct means, by-pass means for receiving at least a second portion of trash which is free to gravitate into said by-pass means as this second portion of trash is being moved superjacent thereto by said beater means, doffing means for removing the seed cotton from said primary saw drum, and seed cotton discharge duct means for receiving the seed cotton from said doffing means and for directing the seed cotton to certain fruther processing apparatus.

* * * * *